US009759045B2

(12) United States Patent
Gross-Petersen

(10) Patent No.: US 9,759,045 B2
(45) Date of Patent: Sep. 12, 2017

(54) SYSTEM FOR FLARE GAS RECOVERY

(75) Inventor: Jørgen Gross-Petersen, Virum (DK)

(73) Assignee: MAERSK OLIE OG GAS A/S, Copenhagen K (DK)

( * ) Notice: Subject to any disclaimer, the term of this patent is extended or adjusted under 35 U.S.C. 154(b) by 751 days.

(21) Appl. No.: 13/391,203

(22) PCT Filed: Aug. 20, 2010

(86) PCT No.: PCT/EP2010/062186
§ 371 (c)(1),
(2), (4) Date: Apr. 19, 2012

(87) PCT Pub. No.: WO2011/020916
PCT Pub. Date: Feb. 24, 2011

(65) Prior Publication Data

US 2012/0315587 A1 Dec. 13, 2012

(30) Foreign Application Priority Data

Aug. 20, 2009 (DK) ..... 2009 70092

(51) Int. Cl.
*F23G 7/08* (2006.01)
*E21B 41/00* (2006.01)
*F23G 5/50* (2006.01)

(52) U.S. Cl.
CPC ..... *E21B 41/0071* (2013.01); *F23G 5/50* (2013.01); *F23G 7/08* (2013.01)

(58) Field of Classification Search
CPC ..... F23G 7/08; E21B 41/0071
USPC ..... 431/202, 112–113, 5; 422/112–113
See application file for complete search history.

(56) References Cited

U.S. PATENT DOCUMENTS

| | | | | |
|---|---|---|---|---|
| 2,844,160 | A * | 7/1958 | Polk | 137/797 |
| 4,188,972 | A * | 2/1980 | van der Zee | 137/489 |
| 4,229,157 | A | 10/1980 | Ito et al. | |
| 4,516,932 | A | 5/1985 | Chaudot | |
| 2005/0080310 | A1* | 4/2005 | Utkilen | 585/818 |
| 2005/0252554 | A1* | 11/2005 | Partridge | F17D 1/20 137/488 |
| 2008/0135238 | A1 | 6/2008 | Cugnet et al. | |

FOREIGN PATENT DOCUMENTS

WO WO 96/10719 A1 4/1996

OTHER PUBLICATIONS

Parry, Cyril F. (1992). "Relief Systems Handbook". Chapter 2. Relief Devices. Institution of Chemical Engineers.*
Taylor, K. and Akins, J. "Technology of the Buckling Pin". Valve Manufacturers Association. 2005.*
P W Thomas, "Multi-stage over pressure protection and product containment on high pressure polymerisation reactors", I. Chem. E. Symposium Series No. 85, Jan. 1, 1984, pp. 229-238.
D S Kayser, "7.17 Rupture Discs INTRODUCTION", Jan. 1, 2003.
(Continued)

*Primary Examiner* — Avinash Savani
*Assistant Examiner* — Vivek Shirsat
(74) *Attorney, Agent, or Firm* — Brinks Gilson & Lione

(57) ABSTRACT

The system fulfills the requirements for safety with its active opening device and with its two levels of different independent mechanical protections against overpressure including a BD with block valves and the BPV without any block valves.

3 Claims, 6 Drawing Sheets

Improved system with additional BPV

(56) References Cited

OTHER PUBLICATIONS

Ori srl: "Rupture Pin valves in Flare systems," Feb. 8, 2001, retrieved from URL http://www.ori.milano.it/admin/tmp/files/Sito/RPT_flare_valves.pdf on Apr. 5, 2012.
Jonathan Miles: "Flare recovery systems and the 'flare bullet'", retrieved from URL http'//www.worldbank.org/html/fd/ggfrforum06/berg/milesv2.ppt on Apr. 5, 2012.
Written Opinion for PCT/EP2010/062186, dated Feb. 20, 2012.
International Search Report for PCT/EP2010/062186, dated Feb. 11, 2011.
Search Report for Application No. PA 2009 70092 dated Mar. 26, 2010.

* cited by examiner

Flaring in the Maersk Oil Danish Operation

Tyra East Flare Rate

Flare gas recovery system with water seal closure

Flare gas recovery system with mechanical closure

Improved flare gas recovery system with additional BD without block valves

Improved flare open recovery system with BD

Improved flare gas recovery system with the BD replaced with a BPV

SYSTEM FOR FLARE GAS RECOVERY

RELATED APPLICATIONS

This application claims the benefit under 35 U.S.C. §371 of International Patent Application No. PCT/EP2010/062186, having an international filing date of Aug. 20, 2010, which claims priority to Danish Patent Application No. PA 2009 70092, filed Aug. 20, 2009, the contents of all of which are incorporated herein by reference in their entirety.

The invention relates to a system for flare gas recovery as described in the preamble of claim 1.

Flaring of gas in connection with the production of hydrocarbons represents both an undesirable emission to the atmosphere and a loss of a valuable resource. Significant efforts have therefore been made by in the prior art to reduce flaring.

A number of flare gas recovery systems have been installed within the last about 10 years, primarily in Norway. These FGR systems are based on blocking of the flare by a Fast Opening Valve (FOV), which opens quickly when the flaring exceeds the capacity of the recovery system. Closure of the flare system allows recovering of the gas from the closed part of the flare in normal operation.

It is an aim of the present invention to improve the safety by including an additional safeguard to provide an acceptable reliability against failure of the opening system.

Further it is also an aim to improve the dynamic operation of the flare system not only during blow down and relief, but also during normal operation or to provide a alternative to the known systems.

This is achieved by a system having two different mechanical protections against overpressure, characterized by two levels of independent mechanical protections against overpressure including a BD with block valves and a BPV without any block valves The two different levels of protection may be defined as different levels of pressure.

The invention will be described in detail in the following with reference to the drawings in which;

FIG. 1 shows facilities in the north sea.

In FIG. 2 is shown a principal sketch of a normal flare system.

The facilities includes in total 7 processing facilities in an integrated production system. The process facilities are Dan F, Halfdan DA, Halfdan BD (being constructed), Gorm, Tyra East, Tyra West and Harald.

Flare systems, and thereby flaring, are fundamental safety critical parts of hydrocarbon processing plants. The prime purpose of the flare gas system is to depressurise the process systems in upset conditions by safely remove the flammable gas inventory and combust this gas in a safe distance from the process plant.

Most process plant flare systems have a high pressure (HP) and a low pressure (LP) flare. All HP components holding large volumes of gas are connected to the HP flare system while the low pressure components holding small volumes of gas only (typically stock tank separator system, degassers etc.) are connected to the LP flare system. The HP flare system is therefore designed to handle high flow rates and operates at a comparatively high pressure, while the LP flare handles the smaller flow rates and operates at a comparatively lower pressure.

Figure 1:
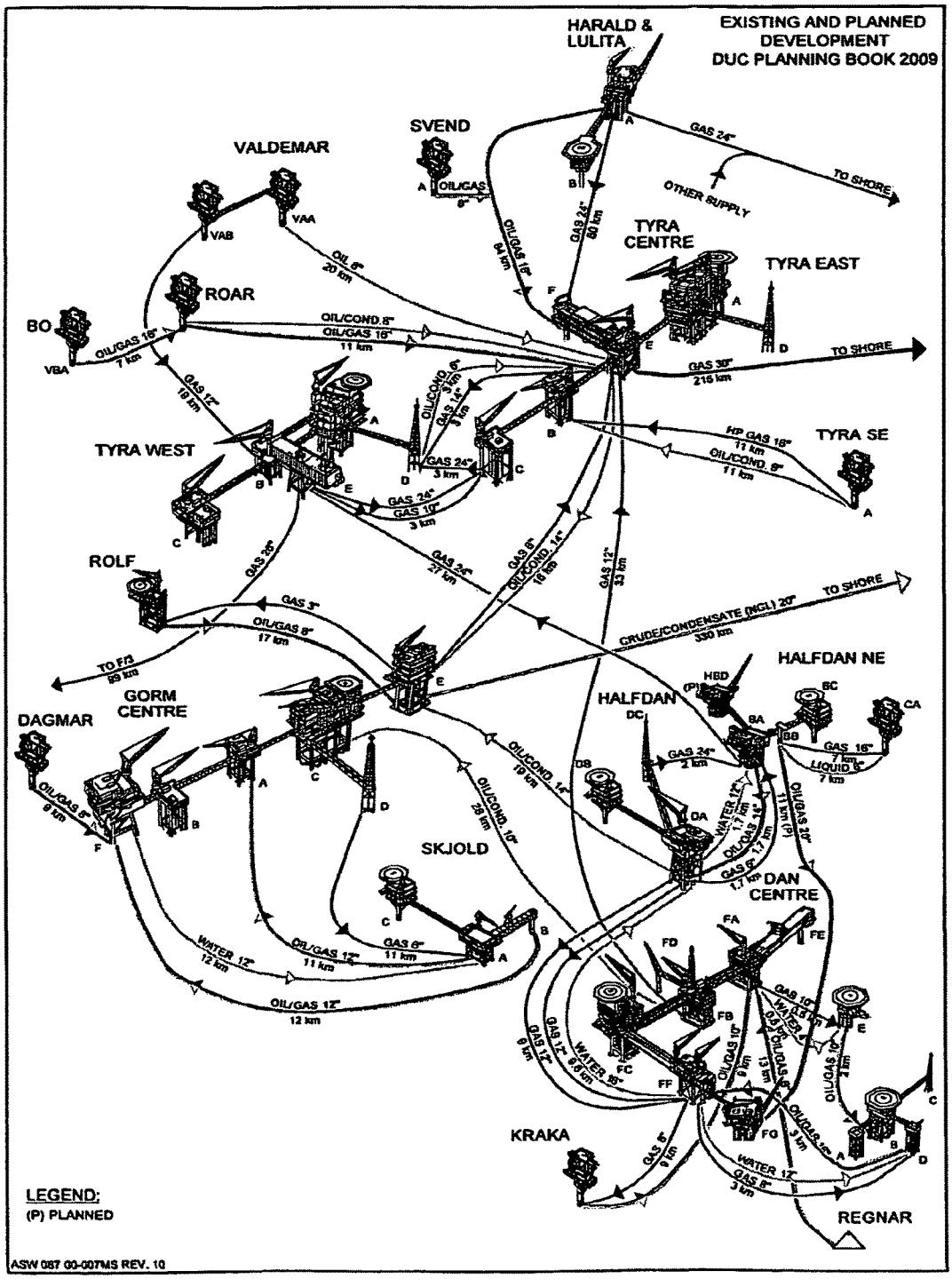
Figure 2:
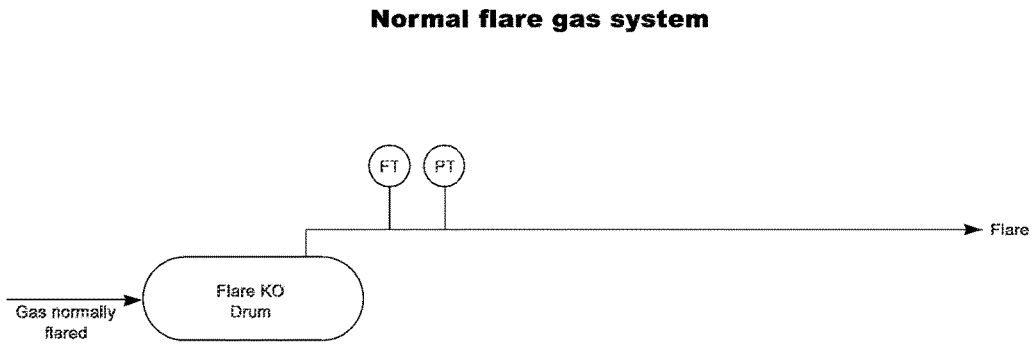

The flare systems normally includes a knock-out (KO) drum for collection of any liquids in the flare system which prevent these being carried out to the atmosphere through the flare, ref. the principal sketch in FIG. 2.

Blow down of the entire hydrocarbon process system or of single trains or equipment may take place. A complete blow down of the hydrocarbon process system may last up to 15 minutes, as large volumes of gas need to be evacuated through the flare. Most flaring originates from the HP flare system and only a small fraction from the LP flare system.

The normal flare systems as shown in FIG. 2 are passive systems with an extremely high reliability as is required for such essential safety system.

Flare systems are normally designed in accordance with API RP 521 (ISO 23251).

The flare systems are comparatively large piping systems sized to handle gas flow rates associated with blow down and relief. During normal operation of the plant only a very small purge rate with hydrocarbon gas is present in the system potentially resulting in very low gas flow rates in a large piping system to prevent atmospheric air to enter the flare system and mix with flare gas to create explosive mixtures. The gas purge also helps to ensure that the flare always is lit such that gas from blown down and relief will be combusted.

Several process conditions contribute to the flaring, some are safety critical and some are production critical. These include:

a) In case of overpressure, safety relief valves will lift and dispose of the gas to the flare. These are rare events and the flaring is safety critical.

b) In case of fire, the hydrocarbon gas inventory is blown down to the flare before the fire weakens elements of the plant, e.g. vessels or piping sufficiently that the gas would escape and cause explosions, etc. These are rare events, and the flaring is safety critical.

c) Emergency shutdown and full or partial blow down occur for a number of process system upsets including fire (ref. b above). However, much more often process shutdowns are caused by manual intervention, false alarms and the fail safe nature of the plant causing shutdowns and subsequent blow down. These are rather frequent events, and it is safety critical flaring or a consequence of safety critical systems.

d) Operational depressurisation occurs e.g. when a vessel requires emptying in connection with maintenance. These are frequent events and include safety critical flaring, but involve relatively small volumes of gas only.

e) In case of start-up, e.g. when major gas treatment components are restarted after planned or unplanned shutdown, gas needs to be flared until sufficient gas quality is obtained. These are frequent events occurring on a daily basis. The flaring is production critical and it may be optimised by, e.g. minimising spurious shutdowns and by process modifications.

f) Gas purge of the flare system is required to ensure a minimum base flow rate out through the flare tip to prevent ingress of oxygen. Flaring of this purge gas is safety critical.

The gas flaring designated as safety critical flaring cannot normally be recovered as capacity is not normally available to process the gas. The contributions from each of the above situations depend on the actual processing plant. In Maersk Oil's North Sea operation, the majority of gas flared is considered to arise from c, e and f.

As can be seen from the description above, recovery of gas from the flare system is only possible for the situation f) gas purge.

This flaring despite being very small rates only constitute a significant part of the total gas flaring, typically about 60% for Maersk Oil's operations on fixed facilities in the North Sea as this flaring is continuous.

Figure 3:
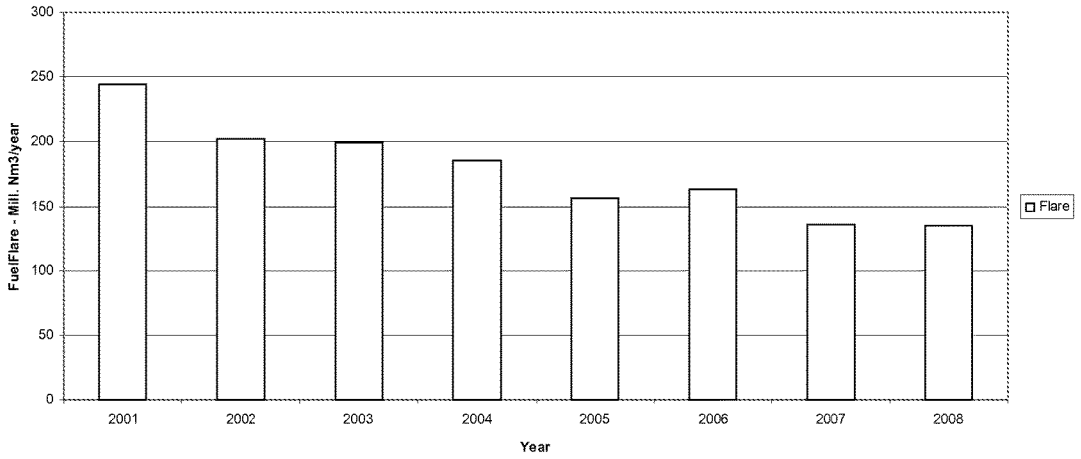
FIG. 3 shows the use of flaring in the period 2001 to 2008.

Significant efforts have been made over the recent years to reduce the flaring on Maersk Oil' processing facilities. FIG. 3 below shows the reduction of flaring despite the fact that the fuel consumption has increased in the period 2001 to 2008.

Figure 4:
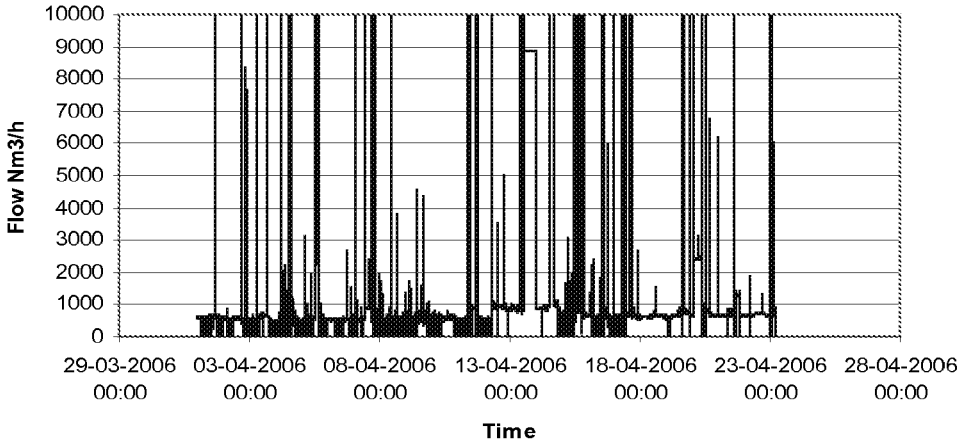
FIG. 4 shows the base flaring on the process platform (Tyra East A).

A typical plot of flow versus time for the Tyra East flare system is shown in FIG. 4.

FIG. 4 shows that the process platform (Tyra East A) has a base flaring of about 500-1000 $Nm^3/h$ or 0.5-1 MMSCFD, process representing condition f) in Sect. 2. The base flow do show flow variations up to about 6000 Nm3/h and some large flows representing process conditions d), c) and e) in Sect. 3. Based on the estimated base flare for each processing facility, the scope of gas recovery with installation of a FGR system is therefore part of this base flow for each facility.

In order further to reduce flaring Maersk Oil planning of FGR to recover this part of the flaring where relevant.

One type commercially available FGR system is based on a water seal to close the flare system and has typically been used for recovery of from LP refinery and petrochemical systems.

Figure 5:
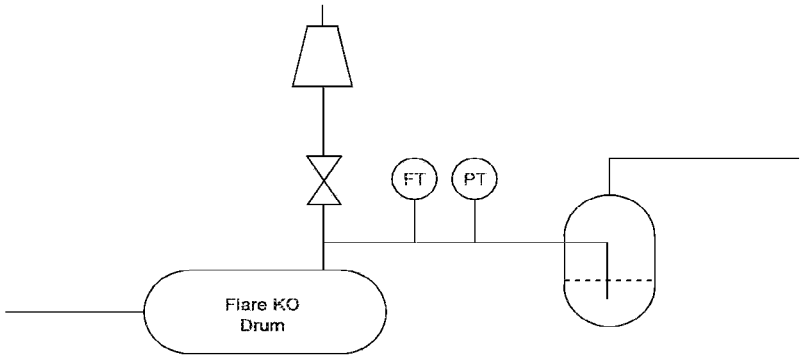
Figure 5 (Prior art)
FIG. 5 shows a principal sketch of a prior art flare gas recovery system.

This type of FGR system is shown on the principal sketch in FIG. 5.

A considerable number of this type of FGR units has been installed worldwide. The system is bulky and heavy particular for HP flare systems with its higher back pressure and is not seen practical for application on process facilities in the North Sea. This type of FGR system has thus not been considered any further in this connection.

Another type of FGR system commercially available utilizes a mechanical closure of the flare. This type FGR system is intended for installation on offshore process facilities. A number of installations offshore exist worldwide, but primarily in Norway and all installed within the last 10 years.

Figure 6:
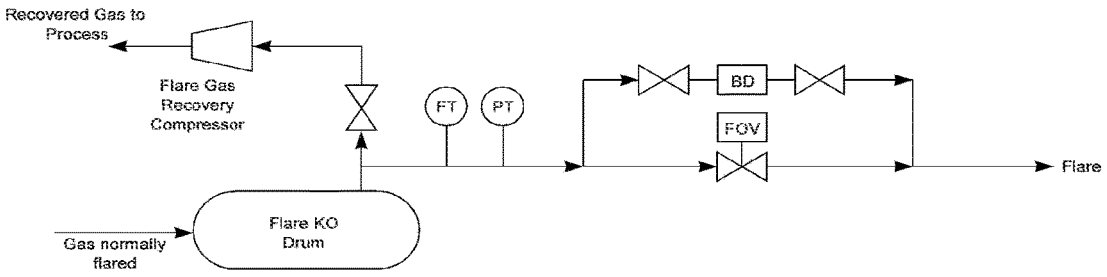
Figure 6 (Prior art)
FIG. 6 shows a principal sketch of a mechanically closed FGR systems.

The FGR system principle is shown on the principal sketch in FIG. 6. The main components of this FGR system are:

1. A Fast Opening Valve (FOV) installed in the flare line after the flare KO drum.
2. A Bursting Disk (BD) with isolation car sealed open block valves on both sides in parallel to the FOV.
3. A flare ignition system using pellets fired from below the flare to ignite flared gas when not being recovered.
4. Gas compression to recover gas from the flare system.

A FGR system of this type is covered by API RP 521, Fifth edition 2007.

Companies has previously considered installation of mechanically closed FGR systems as shown in FIG. 6, but has had reservations with respect to possible safety implications associated with such closure system.

The concern is based on the severe consequences of failure of the system to open when required for the safe removal of gas from the process system in an upset situation. The pressure will in such case increase very fast and rupture would release large volumes of gas in the process facility and the risk of explosion and fire would be high. In the worst case the consequence for the operating personnel could be catastrophic including multiple loss of live and serious facility damage.

In light of the above, the industry is therefore proposing additional safeguards to a FGR system.

Closure of the flare as done by FGR systems commercially available is an efficient approach to FGR. With the low flow rates in the flare in normal operation, it would be technical possible in certain wind conditions both to induce air into the large diameter flare system, while gas is flowing out of the system. Control to avoid ingress of atmospheric air into the flare system without closure will thus be difficult. Atmospheric air in the system is undesirable from a safety point of view.

A closure of the flare system while recovering gas in normal operation by a FGR system is therefore considered necessary. It also offers the advantage that the pressure in the flare system can be raised above atmospheric pressure while recovering gas such minimising the power required for recovery and potentially makes existing LP compression services on the facility available for use for recovery. The higher pressure in the FGR system reduces, however, the ability of the system to absorb pressure surges.

In the light of the severe consequences, if the opening of the flare system should fail, when flaring is required, the opening mechanism has to be very reliable to prevent any overpressure in the flare system. Existing flare systems are typical 150# systems with design pressure around 300 psia. The opening mechanism will also have to be very fast reacting safely to handle the dynamic effects associated with opening of blow down valves or large relief valves. The opening mechanism has therefore to prevent excessive pressure build up in the flare system while opening. Such excessive pressure could pose a major risk to the flare system integrity, and could also result in very large gas velocities in the system during blow down or during relief from a full flow relief valve.

The components considered for closure of the flare system are:

The actuated FOV

The Bursting Dis c (BD)

Buckle Pin valve (BPV)

The FOV has been used for existing FGR systems and is relatively well proven. It is an actuated valve designed to open as fast as possible. The opening time for a FOV is about 2 seconds. As new dedicated local control panel may be desirable if the platform control system does not respond adequately fast, e.g. on older control systems. Some older control systems may only respond after 8-10 seconds. When once activated, the FOV remains open until manually reset when normal operating conditions has been reestablished.

The function of a BPV is rather similar to that of a Pressure Safety Valve (PSV), when opening, but the BPV does not close after opening as the guard pin is permanently buckled. The buckled guard pin needs to be replaced manually with a new one to close and reactivate the BPV. The guard pin replacement can, however, be carried out in operation without any isolation of the BPV from the system pressure as the valve stem can forced down when inserting the new unbuckled pin. Block valve around a BPV is therefore not required. The BPV does not only have a very fast reaction, but the distribution of activation pressure is very narrow and is therefore considered suitable as a first level of protection in addition to the active device.

The BD is extremely fast opening, but suffers from a rather wide distribution of the actual bursting pressure. Replacement of the BD after activation in operation requires isolation of the BD fixture from the system pressure, by closing the block valves. The BD rupture pressure is less well defined compared with say a BPV. Combined with a BD being more complicated to change out when activated, this protection device is seen most suitable as a second level of protection to the active device.

Figure 7:
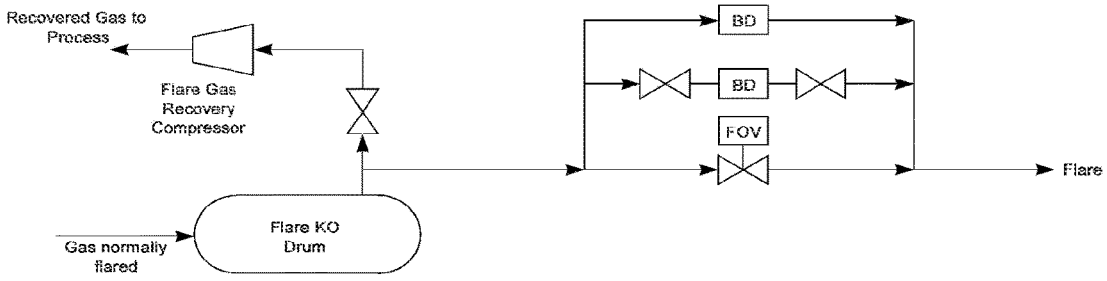
FIG. 7 shows a principal sketch of a flare gas system equipped with of a with a bursting disc
Figure 8:
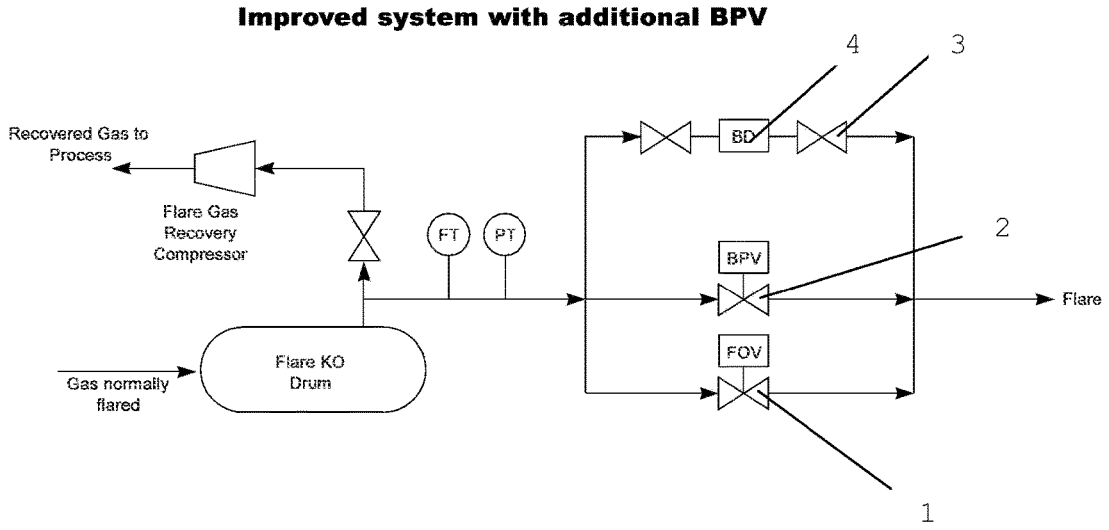
FIG. 8 shows a principal sketch of a flare gas system comprising a braking pin valve.
Figure 9:
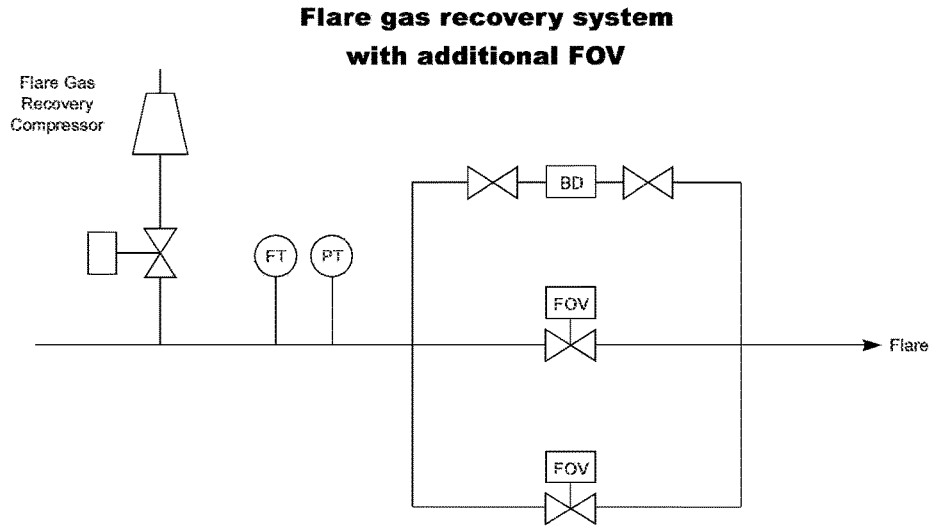
FIG. 9 shows a principal sketch of a flare gas recovery system with additional fast Opening Valve (s).
Figure 10:
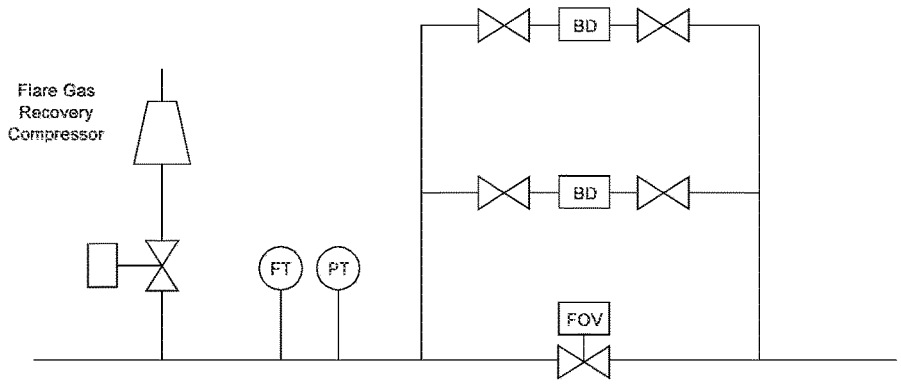
FIG. 10 shows a principal sketch of a flare open recovery system having bursting disk (BD).
Figure 11:
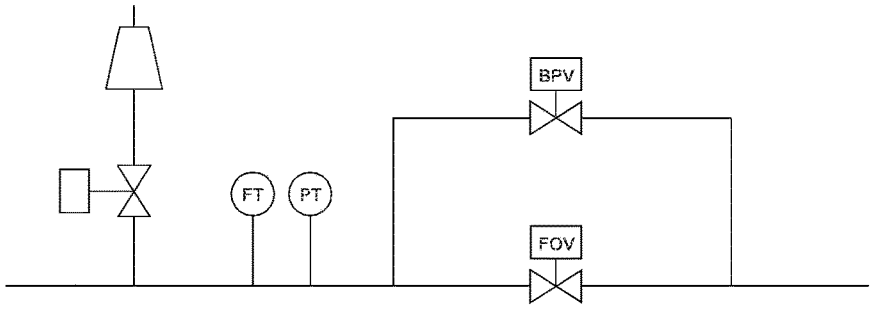
FIG. 11 shows a principal sketch of a flare gas recovery system with the bursting disk (BD) replaced with a braking pin valve (BPV)

Five alternative approaches to a FGR closure system have been evaluated. These are different variations of a closure system retaining the Fast Opening Valve (FOV), but with improved reliability of the opening system. The five options for a FGR system considered for closure of the flare. Principal sketches of the five FGR systems are shown in FIGS. 7-11 below. The five systems are:

- A FGR system with a closure system including a FOV, a BD with car sealed open block valves and a BD without block valves. The last BD set at a higher bursting pressure, ref. FIG. 7.
- A FGR system with a closure system including a FOV (1), a BPV (2) without block valves and a BD (4) with car sealed open block valves (3). The BD set at a higher activation pressure, ref. FIG. 8.
- A FGR system with a closure system including two FOV's, a BD with car sealed open block valves. The BD set at a higher activation pressure, ref. FIG. 9.
- A FGR system with a closure system including a FOV, two BD's both with car sealed open block valves. The one BD set at a higher bursting pressure, ref. FIG. 10.
- A FGR system with a closure system including a FOV and a BPV, ref. FIG. 11.

Other options have been considered but are described in greater details, e.g. an option as in FIG. 8 without the FOV. Such system would e.g. be feasible, if the opening of the flare system closure is a rare event only. Each system includes also the necessary instrumentation and compression for recovery of the flare gas.

All the above systems have an improved level of safety compared with the commercially available system shown in FIG. 6.

A system as in FIG. 7 with a BD without any block valve is feasible and would of a safety point of view be fully acceptable, but suffers from continuous flaring in case of rupture of the BD until the process is closed down and the BD replaced. With the wide distribution of the bursting pressure of BD's, it is probable this could happen despite the two DB's have different set points.

The system shown in FIG. 8 has three different devices for protection. One of the protections is BPV (2) without any block valves. Further, application of different type opening devices is seen as an advantage.

The system shown in FIG. 9 is considered complicated in the sense that two active devices could be required with one as a protection and because in case of a too fast pressure build up, only the BD with car sealed open block valves is available to protect the system.

The system shown in FIG. 10 relies on two types of protection devices, but no device is without car sealed open block valves.

The system shown in FIG. 11 has two protection devices only, but no car sealed open block valves are present.

When defining the FGR system, safety is prime concern, but it is also highly important that the FGR functions optimally, such that a maximum volume of gas is recovered from the system.

An efficient FGR system should have a high uptime, i.e. should recover a high percentage of base flare, ref. f) in Sect. 2. In this connection it is important that the FGR system can handle the normal dynamic flow disturbances from say slugging wells or slugging multiphase pipelines associated with the process facility as shown in FIG. 4. This requires that these regular dynamic disturbances plus the normal gas purge of into the flare system minus the extraction can be accommodated without reaching the set point for opening the flare system closure and relieve the gas. Should the flare closure open, the flare will remain open until reset manually by the operator. A certain minimum volume in the flare system closed in will thus be required in the flare system and in the flare drum to handle these dynamic effects.

The FGR system as shown in FIG. 8 has been selected for the following reasons:

- It applies an active opening device plus two independent different mechanical types of fast opening protection functions, and is considered to be in accordance with ISO 10418 (API 14C).
- Optimal flare gas recovery can be achieved with proper engineering of the dynamic effects of the individual flare system applications.

The mechanically closure of the flare should as indicated above be located downstream of the Flare KO drum allowing liquids to drained continuously from the system, and as close to the flare tip as practically possible. This will maximise the inventory available in the closed part of the system. Should a large inventory in a particular application not be required this issue may be of less importance, but will also limit the capability to handle any possible future increased slugging. It the volume is too small to handle the blow down and relief situations, additional volume may be required by installation of further flare header, a larger flare KO drum or an additional vessel.

The selection of set points for the system will need to be assessed for any particular application. An operating pressure in the closed part of the flare system is expected around 2-3 Barg. The BPV should be set as low as possible without normally being activated by regular dynamic behaviour of the system (say slugging). The BD should set a high as practically possible to prevent activation and at the same time avoid overpressure of the closed part of the flare system.

Continuous purge, normally by nitrogen, is required downstream of the FOV, when closed, to prevent air ingress into the main flare stack, and also to remove any residual unburnt hydrocarbon gas.

The detailed design of the new FGR system is now being completed. The FGR system is a prototype design and this system is planned installed on a single process facility first in order to verify the proper functional performance the FGR prior to any general application to all relevant process facilities.

The experience with the prototype is expected available during 2011. Any improvements of the FGR following the testing of the prototype can then be included into the further FGR systems planned installed.

A FGR system as defined above requires an ignition system to ensure that the flare gas from the flare system is burned. The following options for an ignition systems have been considered:

Pilot flame

Conventional igniting system

Pellet launch system

Ignition of the flare by a signal pistol is only seen as a manual back up system.

The pilot flare has been rejected due to the continuous consumption of gas for the pilot. Such continuous gas consumption for a pilot flare counteracts the recovery of gas by the FGR system.

A conventional ignition system has also been rejected due to previous poor experience with this type of system.

The pellet launch type of ignition system has therefore been selected with an air launcher firing a small pellet onto a plate at the flare tip generating the sparks to ignite the gas. The firing of the air gun forms part of the FOV opening. A magazine of pellets is available in the pellet launcher to allow relaunching, should this be necessary, (say at malfunction of a pellet).

The selection of the pellet type of ignition is also expected significantly to extend the lifetime of the flare tip as the flare is not normally alight with the small continuous pilot flame, which tends to damage the flare tip, as this is designed efficiently to combust much larger flare rates. Flare tip change out's may thus be significantly reduced with such safe and efficient FGR system installed.

A suitable flare recovery gas compression system is required for return of the gas recovered to the process system. The configuration and type of compression system depends on the pressure level available in the system for return of the gas. Suitable compressors could be screw type compressors, ejectors or an existing compressor. The election of a suitable compressor is always highly dependent on the process system and is not covered further in this connection.

As already mentioned previously, the FOV should open as fast as possible to limit pressure build up in the closed part of the flare system. The FOV is operated from pressure transmitter(s) in the closed part of the flare system, but this opening is supplemented by opening of the FOV from the ESD system, e.g. in parallel with opening of the BDV's. This will ensure a fast opening of the FOV in case of blow down and relief as it avoids having the opening of the FOV triggered through a cascading via the pressure transmitter detecting the increasing pressure in the closed part of the flare system.

The invention claimed is:

1. A flare gas system for flaring gas in a closed portion of the flare gas system comprising:

a fast opening valve (FOV) fluidly coupled to the closed portion configured to open upon receipt of a signal from a pressure transmitter indicative of a gas pressure in the closed portion being higher than a first threshold to thereby flare gas in the closed portion and prevent the pressure in the closed portion from exceeding the first threshold for any fluid flow rate in the closed portion when the FOV is opened;

a braking pin valve (BPV) fluidly coupled to the closed portion configured to open when the pressure in the closed portion exceeds a second threshold to thereby flare gas in the closed portion and prevent the pressure in the closed portion from exceeding the second threshold; and a bursting disk valve (BDV) fluidly coupled to the closed portion configured to open when the pressure in the closed portion exceeds a third threshold to thereby flare gas in the closed portion and prevent the pressure in the closed portion from exceeding the third threshold, wherein the first threshold is less than the second threshold, which is less than the third threshold, to thereby facilitate recovery of as much flare gas as possible, wherein the FOV is further configured to open responsive to a control from an emergency shut down system (ESD) when the BDV opens to thereby ensure fast opening of the FOV in parallel with BDV.

2. The flare gas system according to claim 1, further comprising at least one block valve between the closed portion and the BD.

3. The flare gas system according to claim 1, wherein said fast opening valve is configured to have an opening time of as fast as two seconds.

* * * * *